US010609988B2

(12) United States Patent
Ha et al.

(10) Patent No.: US 10,609,988 B2
(45) Date of Patent: Apr. 7, 2020

(54) WIRE TIGHTENING APPARATUS

(71) Applicant: SHINKYUNG INC., Busan (KR)

(72) Inventors: Gi Ho Ha, Busan (KR); Min Woo Ha, Busan (KR)

(73) Assignee: SHINKYUNG INC., Busan (KR)

( * ) Notice: Subject to any disclaimer, the term of this patent is extended or adjusted under 35 U.S.C. 154(b) by 379 days.

(21) Appl. No.: 15/576,994

(22) PCT Filed: Sep. 18, 2017

(86) PCT No.: PCT/KR2017/010154
§ 371 (c)(1),
(2) Date: Nov. 27, 2017

(87) PCT Pub. No.: WO2018/101588
PCT Pub. Date: Jun. 7, 2018

(65) Prior Publication Data

US 2019/0008236 A1 Jan. 10, 2019

(30) Foreign Application Priority Data

Nov. 29, 2016 (KR) ..... 10-2016-0159822

(51) Int. Cl.
*A43C 11/16* (2006.01)
*A43C 11/20* (2006.01)
(Continued)

(52) U.S. Cl.
CPC ..... *A43C 11/165* (2013.01); *A43B 3/0078* (2013.01); *A43C 7/00* (2013.01); *A43C 11/20* (2013.01)

(58) Field of Classification Search
CPC ..... A43C 11/165; A43C 7/00; A43C 11/20; A43B 3/0078
See application file for complete search history.

(56) References Cited

U.S. PATENT DOCUMENTS

2015/0007422 A1* 1/2015 Cavanagh ..... A43C 11/165 24/68 SK
2015/0313319 A1* 11/2015 Ha ..... A43C 11/165 24/303

(Continued)

FOREIGN PATENT DOCUMENTS

WO WO-2017138686 A1 * 8/2017 ..... A43C 7/00

*Primary Examiner* — William A. Rivera
(74) *Attorney, Agent, or Firm* — Paratus Law Group, PLLC

(57) ABSTRACT

A wire tightening apparatus including: a base body part; a reel part rotatably installed inside the base body part to selectively wind a wire thereon when rotated; a housing part including a ratchet-type gear, a partition plate protruding radially inward along a lower portion of the ratchet-type gear, and a vertical movement hole; a vertically moving gear part including a gear body part configured to be vertically moved along the vertical movement hole and having a seating step, an elastic blade part coupled to the ratchet-type gear so that one-way rotation thereof is restricted, and a vertical movement fixing extension part selectively elastically supported by upper and lower surfaces of an edge of the vertical movement hole; and a cover part coupled to an upper portion of the vertically moving gear part to be integrally vertically moved and rotated therewith.

5 Claims, 5 Drawing Sheets

(51) Int. Cl.
*A43C 7/00* (2006.01)
*A43B 3/00* (2006.01)

(56) References Cited

U.S. PATENT DOCUMENTS

| | | | | |
|---|---|---|---|---|
| 2018/0160775 | A1* | 6/2018 | Pollack | B65H 75/4449 |
| 2019/0000187 | A1* | 1/2019 | Chen | B65H 75/4402 |
| 2019/0150569 | A1* | 5/2019 | Chen | A43C 11/165 |
| 2019/0174869 | A1* | 6/2019 | Wang | B65H 75/26 |
| 2019/0320763 | A1* | 10/2019 | Jiang | A43C 11/165 |

* cited by examiner

【Fig. 1】
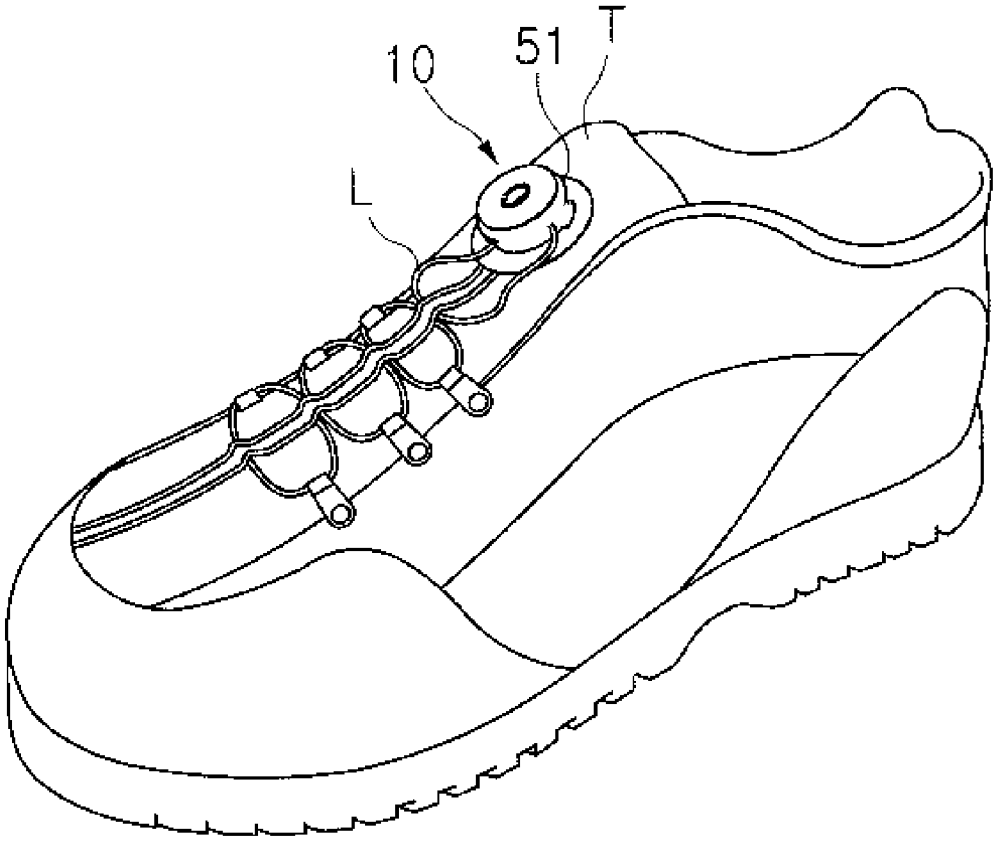

【Fig. 2】
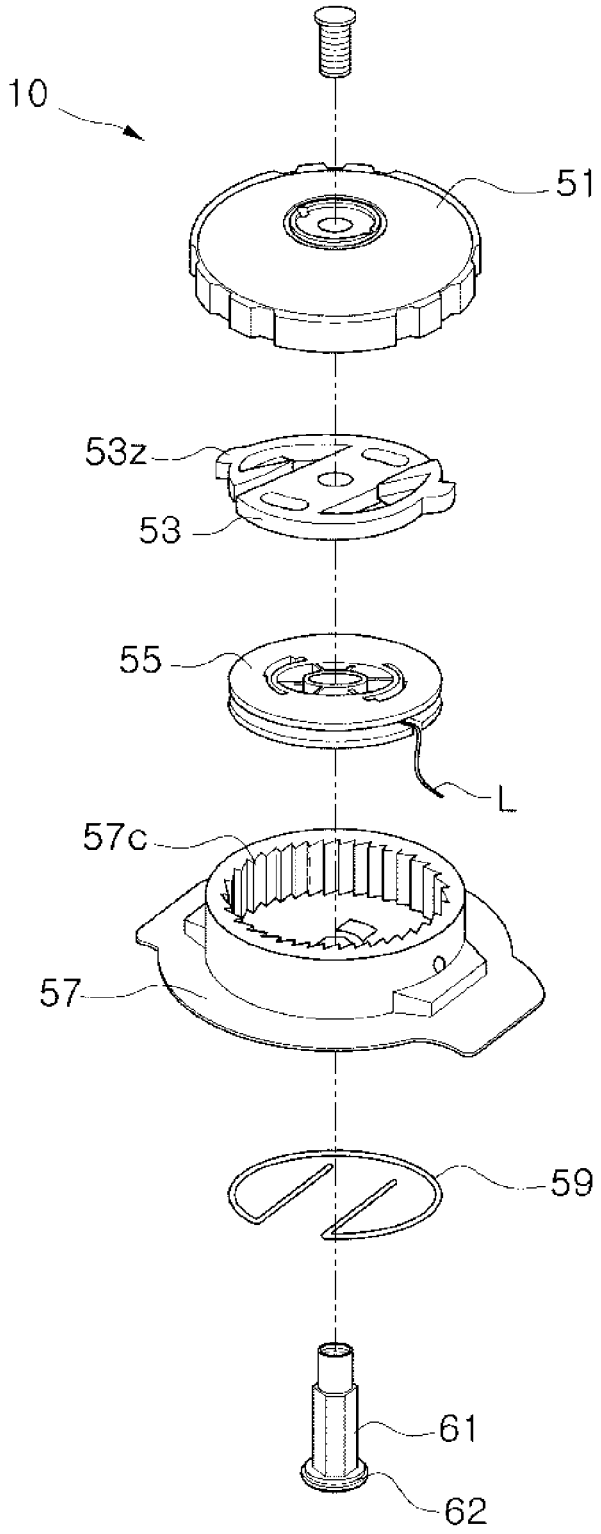

【Fig. 3A】
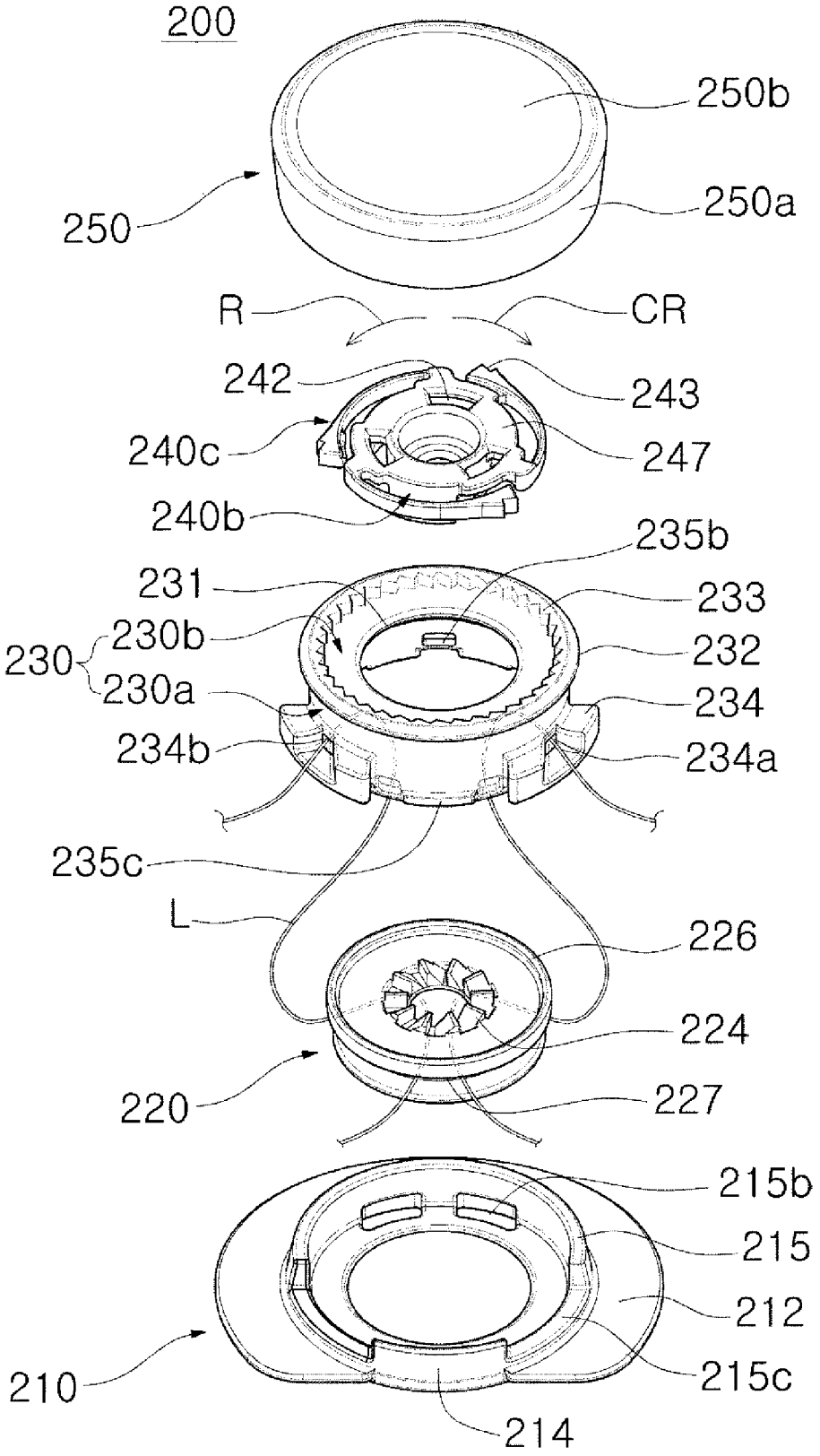

【Fig. 3B】
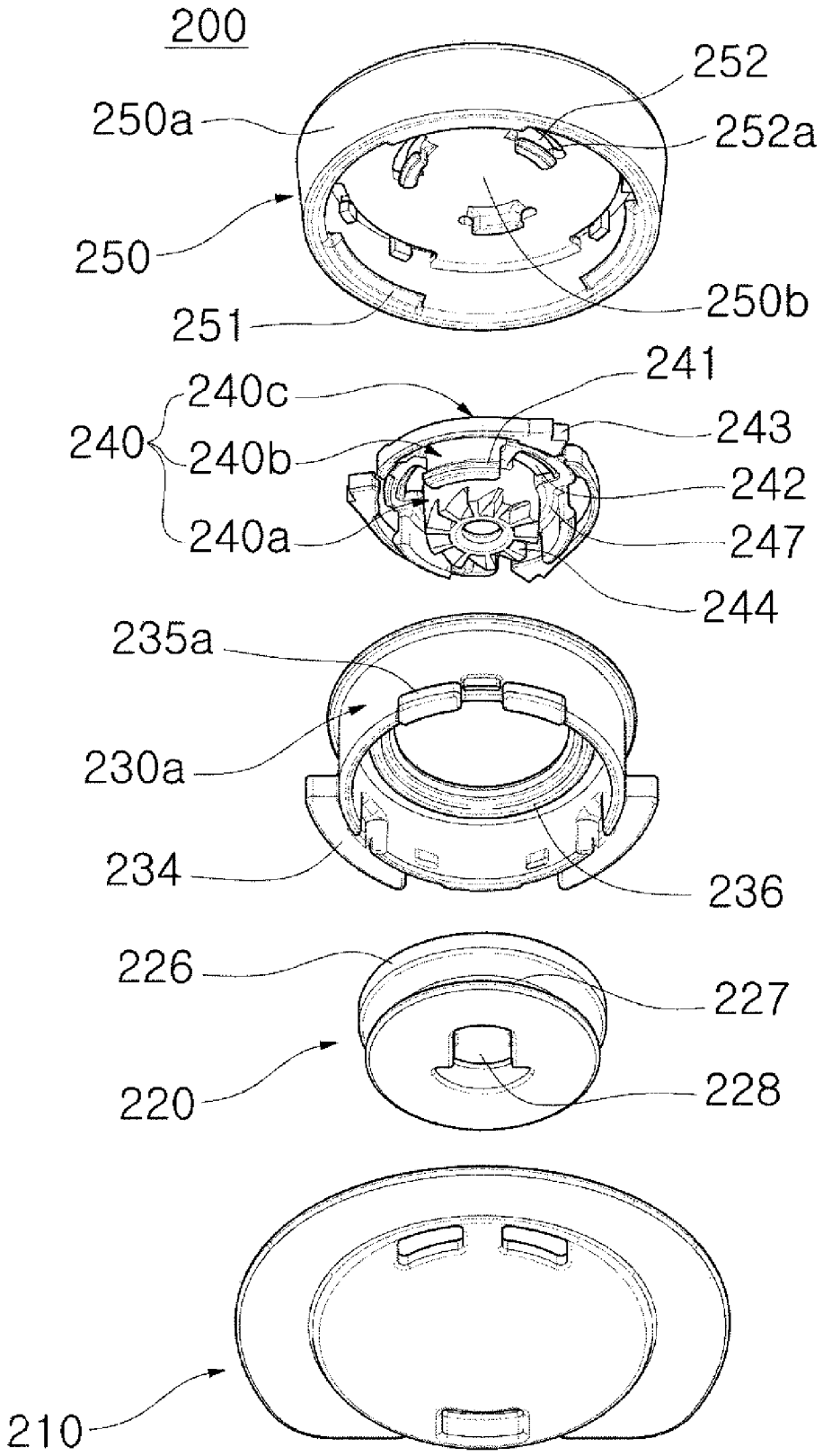

【Fig. 4A】
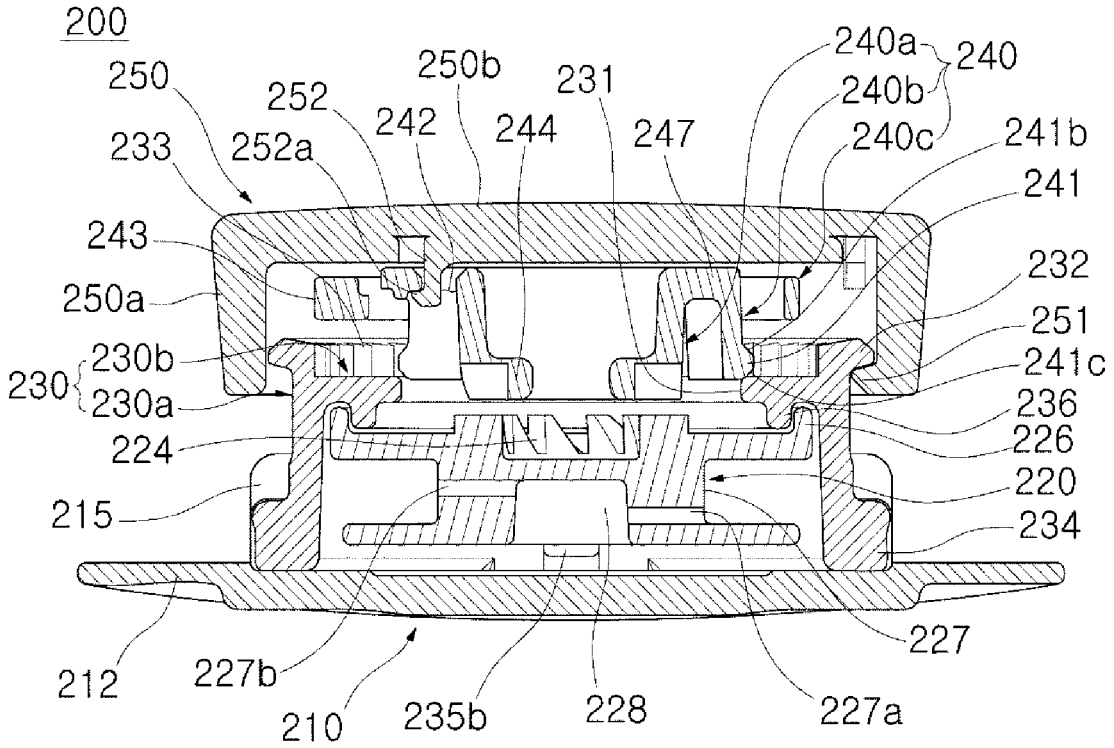
【Fig. 4B】
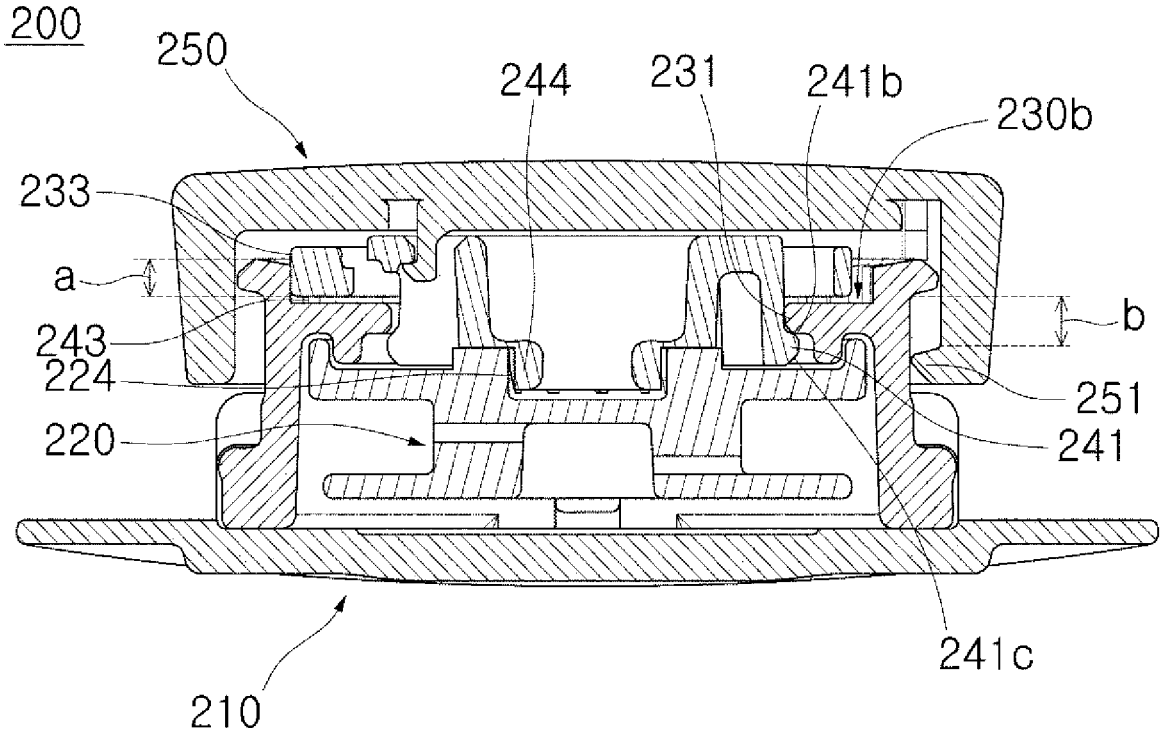

WIRE TIGHTENING APPARATUS

CROSS REFERENCE TO PRIOR APPLICATIONS

This application is a National Stage Patent Application of PCT International Patent Application No. PCT/KR2017/010154 (filed on Sep. 18, 2017) under 35 U.S.C. § 371, which claims priority to Korean Patent Application No. 10-2016-0159822 (filed on Nov. 29, 2016), which are all hereby incorporated by reference in their entirety.

TECHNICAL FIELD

The present invention relates to a wire tightening apparatus, and more particularly, to a wire tightening apparatus with enhanced assemblability and durability.

BACKGROUND ART

Generally, shoes such as running shoes and the like are configured such that shoelaces are laced in a zigzag form to closely contact the feet of a user. Close contact between shoes and the feet of a user is enhanced by tightening shoelaces by pulling them, and thus comfortable walking is enabled.

However, it is not easy for lower grade elementary school students, pre-school children, or the elderly to loosen and tighten shoelaces.

In addition, opposite end portions or knots of loosened shoelaces may be untied due to vigorous movement, caught by an external object or the like during exercise such as climbing, track cycling, and the like. In such a case, the untied shoelaces result in poor performance and an increased risk of injury due to accidents, and thus it is necessary to completely prevent shoelaces from becoming untied.

In addition, rest may be sufficiently taken only when firmly tightened shoelaces are untied, and thus, most preferably, the shoelaces should be easily tightened, a tightened state thereof should be stably maintained, and the shoelaces should be loosened easily when necessary.

Thus, a variety of apparatuses for facilitating tightening and loosening of shoelaces, which are opposite operations, have been developed.

FIG. 1 is a perspective view of a shoe equipped with a conventional shoelace tightening apparatus 10. FIG. 2 is an exploded perspective view of the conventional shoelace tightening apparatus 10.

As illustrated in FIGS. 1 and 2, the conventional shoelace tightening apparatus 10 is provided at a tongue T of the shoe, and, when a rotary cover 51 is rotated, an intermediate member 53 and a winding member 55 are coupled and rotated together. At this time, a shoelace L is wound on the winding member 55, and an engagement and restriction portion 53*z* of the intermediate member 53 is locked in a one-way ratchet gear 57*c* of a housing 57 to be locked not to be rotated in a reverse direction.

Subsequently, when the rotary cover 51 is pulled upward, a locking step portion 62 of a rotary shaft 61 is moved upward while stretching an elastic member 59 by elastically pressing the elastic member 59, and the intermediate member 53 is lifted. Accordingly, the intermediate member 53 and the winding member 55 are uncoupled and the shoelace L may be loosened by being pulled via free rotation of the winding member 55.

For this, the elastic member 59 formed of a U-shaped thin metal is separately fabricated, and the elastic member 59 has problems in terms of being assembled in the shoelace tightening apparatus 10 via complicated assembly processes.

In addition, the conventional shoelace tightening apparatus 10 has problems in that, when the rotary cover 51 is pulled upward so that the shoelace is loosened, the elastic member 59 escapes from its original position, and thus a product breaks down which results in reduced durability and reliability of the product. To address these problems, when a lower structure of the housing 57 to which the elastic member 59 is coupled is deformed into a complicated structure, the number of components has been increased, however this has led to productivity of products being deteriorated.

Furthermore, the rotary cover 51 and the rotary shaft 61 are fastened to each other by a bolt member, and thus, when the bolt member is not completely fastened, malfunction occurs. In addition, when the rotary cover 51 is forcibly manipulated, the rotary shaft 61, which is made of an injection-molded resin material, is easily broken by the bolt member, which is made of a metal material.

DISCLOSURE

Technical Problem

To address the above-described problems, an object of the present invention is to provide a wire tightening apparatus with enhanced assemblability and durability.

Technical Solution

According to an embodiment of the present invention, a wire tightening apparatus includes: a base body part provided with an accommodation barrier part at an upper surface portion thereof; a reel part rotatably installed inside the accommodation barrier part to selectively wind a wire thereon when rotated; a housing part including: a fastening barrier part having a lower end portion coupled to the accommodation barrier part and provided, at an upper end portion of an inner circumference thereof, with a ratchet-type gear protruding therefrom; and a partition plate protruding radially inward along a lower portion of the ratchet-type gear so that an upper end of the reel part is restricted, and having a vertical movement hole in a central portion thereof; a vertically moving gear part including: a gear body part configured to be vertically moved along the vertical movement hole, coupled to the reel part when moving downward to be integrally rotated therewith, and having a seating step protruding from an outer circumference thereof; an elastic blade part provided at an outer circumference of the seating step and coupled to the ratchet-type gear so that one-way rotation thereof is restricted; and a vertical movement fixing extension part protruding from a lower surface portion of the seating step and selectively elastically supported by upper and lower surfaces of an edge of the vertical movement hole; and a cover part coupled to an upper portion of the vertically moving gear part to be integrally vertically moved and rotated therewith.

Advantageous Effects

Through the above-described technical solution, a wire tightening apparatus of the present invention provides the following effects:

First, vertical movement fixing extension parts extending downward from an upper end portion of a vertically moving gear part are elastically caught by an edge of a vertical movement hole of a housing part. Accordingly, a vertical movement state for restricting free rotation and one-way rotation of a reel part is maintained without additional components such as conventional rotary shaft/elastic member, and the like, and thus the number of components decreases, and, accordingly, productivity and assemblability of products can be enhanced.

Second, the vertical movement fixing extension parts extend so as to face an inner side end of a partition plate protruding to restrict an upper end of the reel part. Through this, a separate protruding or recessed structure for elastically catching a locking protrusion is not needed, and thus a structure of the housing part can be simplified, and, accordingly, difficulties in molding and fabrication of components can be reduced, resulting in enhanced product productivity.

Third, a rail coupling part protruding from an upper surface portion of the reel part is guided by a rail guide part of the partition plate, and thus stable rotation of the reel part is enabled without additional components such as a conventional rotary shaft, resulting in enhanced product productivity. In addition, interference of a rotary shaft in a connection portion between wires located on an inner side of the reel part is removed, and thus installation and replacement convenience of the wires can be enhanced.

Fourth, opposite ends of the wire are restricted by a pair of wire fastening holes alternately arranged vertically to be vertically separated and wound. Accordingly, twisting and tangling between the wires are minimized, and thus stable tightening and loosening are enabled even when the reel part is repeatedly rotated in one direction and in another direction, and, accordingly, operation reliability of products can be enhanced.

DESCRIPTION OF DRAWINGS

FIG. 1 is a perspective view of a shoe equipped with a conventional shoelace tightening apparatus.

FIG. 2 is an exploded perspective view of the conventional shoelace tightening apparatus.

FIGS. 3A and 3B are exploded perspective views of a wire tightening apparatus according to an embodiment of the present invention.

FIGS. 4A and 4B are cross-sectional views of the wire tightening apparatus according to an embodiment of the present invention.

BEST MODE

Hereinafter, best modes of the present invention will be described in more detail with reference to the accompanying drawings.

MODE OF THE INVENTION

Hereinafter, a wire tightening apparatus according to an exemplary embodiment of the present invention will be described in detail with reference to the accompanying drawings.

FIGS. 3A and 3B are exploded perspective views of a wire tightening apparatus 200 according to an embodiment of the present invention. FIGS. 4A and 4B are cross-sectional views of the wire tightening apparatus 200 according to an embodiment of the present invention.

As illustrated in FIGS. 3A to 4B, the wire tightening apparatus 200 includes a base body part 210, a reel part 220, a housing part 230, a vertically moving gear part 240, and a cover part 250.

In this regard, the base body part 210 is a support structure fixed to an object to be tightened, such as a shoe or the like, and may be formed of a resin material that has a certain degree or more of strength and is elastic, such as reinforced plastic or the like.

In addition, in a state in which the reel part 220 is coupled to an inside of the housing part 230 and the vertically moving gear part 240 and the cover part 250 are coupled to an upper portion of the housing part 230, the housing part 230 may be attachable or detachable to or from an upper portion of the base body part 210.

That is, an assembly of the housing part 230, the reel part 220, the vertically moving gear part 240, and the cover part 250 is coupled to the upper portion of the base body part 210. In addition, the reel part 220 may be accommodated in an accommodation space formed when the housing part 230 and the base body part 210 are coupled to each other and be rotated.

In this regard, the vertically moving gear part 240 may be assembled to the housing part 230 such that rotation thereof in a direction R is restricted, and may be coupled to the reel part 220 to integrally rotate in another direction CR when moving downward.

In addition, the cover part 250 is coupled to an upper end portion of the housing part 230 to be rotated and vertically moved independently from the housing part 230 fixed to an object to be tightened, via the base body part 210.

At this time, the cover part 250 is coupled to the vertically moving gear part 240 to be integrally rotated and vertically moved, and thus the vertically moving gear part 240 may be vertically moved and rotated in the other direction CR according to manipulation of the cover part 250.

In addition, when the cover part 250 is rotated in the other direction CR in a state in which the vertically moving gear part 240 is moved downward and integrally coupled to the reel part 220, a wire L connected to the object to be tightened may be wound on the reel part 220.

At this time, rotation of the reel part 220 in the direction R is restricted by the vertically moving gear part 240, and the wound state of the wire L may be maintained.

In addition, when the cover part 250 is pulled upward, the vertically moving gear part 240 is moved upward and separated from the reel part 220, and a state of the reel part 220 is converted into a freely rotatable state such that the wound wire L may be loosened.

In addition, rotation directions of the reel part 220, the vertically moving gear part 240, and the cover part 250 that are configured to wind and unwind the wire L may be easily modified in terms of design by changing a shape of each of the constituent components, which will be described below.

Meanwhile, referring to FIGS. 3A and 3B, the base body part 210 includes a tongue support part 212 and an accommodation barrier part 215. In this regard, the tongue support part 212 has a rounded lower surface portion to closely support a tongue or the like of a shoe, and the accommodation barrier part 215 protrudes upward from a central portion of an upper surface of the tongue support part 212.

In addition, openings 215*c* having a predetermined insertion angle are formed in one circumferential side of the accommodation barrier part 215. That is, the accommodation barrier part 215 is provided in a circular arc form having an angle except for the insertion angle from 360°, which is a central angle of a circle.

In addition, restriction groove portions 215*b* are recessed radially outward from an inner circumferential surface of another circumferential side of the accommodation barrier part 215 that faces the openings 215*c*.

In addition, a fastening elastic piece 214 protrudes upward from an upper surface portion of the tongue support part 212 to be elastically deformed in a radial direction on a side corresponding to the openings 215*c*, and a housing assembling protrusion (not shown) protrudes from an inner circumferential surface of the fastening elastic piece 214.

Meanwhile, referring to FIGS. 3A to 4A, the reel part 220 may be made of a resin material such as reinforced plastic or the like, configured to have an outer diameter less than an inner diameter of the accommodation barrier part 215, and rotatably positioned inside the accommodation barrier part 215.

In this case, the reel part 220 is provided, at a side wall portion thereof, with a wire winding groove 227 recessed radially inward and having a circumferential shape corresponding to a rotation direction of the reel part 220, and the wire winding groove 227 has a pair of wire fastening holes 227*a* and 227*b* formed to pass through the wire winding groove 227.

Here, the wire fastening holes 227*a* and 227*b* radially pass through the wire winding groove 227 so that the wire winding groove 227 and a knot accommodation groove 228 formed in the reel part 220 are connected to each other.

At this time, as opposite end portions of the wire L passing through the wire fastening holes 227*a* and 227*b* are connected to each other by a knot formed in the knot accommodation groove 228 or another fixing member, the wire L may be restricted by an edge of each of the wire fastening holes 227*a* and 227*b* on the side of the wire winding groove 227.

Accordingly, when the reel part 220 is rotated, the wire L is wound along the wire winding groove 227 such that the object to be tightened may be tightened.

In this regard, the wire fastening holes 227*a* and 227*b* may be alternately arranged vertically within different height ranges. That is, one of the wire fastening holes, i.e., the wire fastening hole 227*b*, may be formed on an upper side of the wire winding groove 227, and another thereof, i.e., the wire fastening hole 227*a*, may be formed on a lower side of the wire winding groove 227.

In this case, when the reel part 220 is rotated, one end of the wire L fixed to the wire fastening hole 227*b* formed on an upper side and another end of the wire L fixed to the wire fastening hole 227*a* formed on the lower side may be vertically separated inside the wire winding groove 227 and wound.

Thus, even when rotation of the reel part 220 in the direction R and the other direction CR is repeated, the wire L is wound in a state of being restricted by each of the wire fastening holes 227*a* and 227*b*. Accordingly, twisting and tangling between opposite ends of the wire L are minimized, and thus operational reliability and durability of a product may be enhanced due to stable tightening and loosening operations.

In addition, the reel part 220 is provided, at a central portion of an upper surface thereof, with a gear coupling part 224 to be integrally rotated therewith when the vertically moving gear part 240 is lowered, and a rail coupling part 226 is provided at an edge region of the gear coupling part 224.

Meanwhile, the housing part 230 includes a fastening barrier part 230*a* and a partition plate 230*b*, and may be made of a resin material such as reinforced plastic, or the like.

In this regard, the fastening barrier part 230*a* has a height exceeding a vertical height of the reel part 220 and is configured to have a continuous circumferential surface having an inner diameter equal to or greater than a maximum outer diameter portion of the reel part 220.

Accordingly, the reel part 220 may be rotatably accommodated inside the fastening barrier part 230*a*.

In addition, the fastening barrier part 230*a* is configured to have an outer diameter corresponding to the inner diameter of the accommodation barrier part 215, and engagement cover protrusions 234 protrude from one side of an outer circumference of the fastening barrier part 230*a* to be inserted into the openings 215*c*.

That is, a pair of the engagement cover protrusions 234 are provided to correspond to spaces on one side and another side of the openings 215*c* divided by the fastening elastic piece 214 to be engaged with and inserted into the spaces on the one side and the other side of the openings 215*c*.

In this case, a fastening protrusion 235*c* protrudes from a lower end of one side of the outer circumference of the fastening barrier part 230*a*, between the engagement cover protrusions 234 to be hook-coupled to the housing assembling protrusion (not shown).

In addition, base assembling protrusions 235*a* protrude from another side of the outer circumference of the fastening barrier part 230*a* to be inserted into the restriction groove parts 215*b*.

Specifically, when the engagement cover protrusions 234 are configured to face the spaces of the one side and the other side of the openings 215*c*, the fastening barrier part 230*a* may be inserted into the accommodation barrier part 215.

At this time, in a state in which the fastening elastic piece 214 is elastically deformed radially outward, the base assembling protrusions 235*a* may be moved toward the restriction groove parts 215*b* by sliding along an inner surface of the accommodation barrier part 215.

In addition, when the base assembling protrusions 235*a* are inserted into the restriction groove parts 215*b*, the outer circumference of the fastening barrier part 230*a* is brought into close contact with an inner circumference of the accommodation barrier part 215 and the fastening elastic piece 214 is elastically restored radially inward.

In this case, the base body part 210 and the housing part 230 may be assembled such that the base assembling protrusions 235*a* are restricted by upper ends of the restriction groove parts 215*b*, and the housing assembling protrusion (not shown) and the coupling protrusion 235*c* are caught.

In this regard, when assembly of the base body part 210 and the housing part 230 is completed, the openings 215*c* may be covered by the engagement cover protrusions 234. In addition, an accommodation space may be formed by the accommodation barrier part 215, the fastening barrier part 230*a*, and the tongue support part 212 to accommodate the reel part 220.

In addition, in a state in which the housing part 230 and the base body part 210 are coupled to each other, when the fastening barrier part 230*a* is pulled upward in a diagonal direction while pressing the fastening elastic piece 214 radially outward, the housing part 230 may be separated from the base body part 210.

Meanwhile, a reel assembling protrusion 235*b* may protrude radially inward from an inner circumference of the fastening barrier part 230*a* so that a lower end of the reel part 220 is elastically caught thereby. In this case, the reel assembling protrusion 235*b* may be provided in plural in a circumferential direction at the same height.

Specifically, the fastening barrier part 230*a* has a pair of wire through-holes 234*a* and 234*b* passing therethrough, and the wire L connected to the object to be tightened may pass through the wire through-holes 234*a* and 234*b* and be restricted by the wire fastening holes 227*a* and 227*b* of the reel part 220.

In addition, when the wire L passing through the wire through-holes 234*a* and 234*b* is restricted by the wire fastening holes 227*a* and 227*b*, the reel part 220 is inserted into the fastening barrier part 230*a* via a lower opening of the fastening barrier part 230*a*.

That is, in a state in which the housing part 230 and the base body part 210 are separated from each other, the reel part 220 may be assembled to the fastening barrier part 230*a* such that the reel part 220 is inserted into the fastening barrier part 230*a*, and the lower end thereof is elastically caught by the reel assembling protrusion 235*b*.

At this time, the reel part 220 may be post-assembled after the cover part 250 and the vertically moving gear part 240 are assembled to the housing part 230, and may also be previously assembled before assembly of the cover part 250 and the vertically moving gear part 240.

Accordingly, the housing part 230, the reel part 220, the vertically moving gear part 240, and the cover part 250 may be assembled and modularized, and a modularized upper assembly may be attachable or detachable to or from the base body part 210.

Due to such a configuration, an operation of connecting the wire L, which is connected to the object to be tightened, to the reel part 220 may be separated from an operation of sewing the base body part 210 onto the object to be tightened or fixing the base body part 210 to the object to be tightened by an adhesive or the like, and thus assembly convenience of a product may be enhanced.

In addition, the upper assembly including the reel part 220 may be easily separated from the base body part 210 to replace old wires or components, and thus maintenance, repair, and convenience of use of a product may be significantly enhanced.

Meanwhile, the fastening barrier part 230*a* is provided, at an inner circumference of an upper end thereof, with a ratchet-type gear 233 protruding therefrom, and the partition plate 230*b* protrudes radially inward along a lower portion of the ratchet-type gear 233 so that an upper end of the reel part 220 is restricted thereby.

In addition, the partition plate 230*b* is provided, at a central portion thereof, with a vertical movement hole 231 having a cross-sectional area less than that of the reel part 220 and a size exceeding that of the gear coupling part 224 to pass therethrough. In this case, a distance from the reel assembling protrusion 235*b* to a lower surface portion of the partition plate 230*b* may be configured to exceed the vertical height of the reel part 220.

As used herein, the expression "the upper end of the reel part 220 is restricted by the partition plate 230*b*" may be understood as meaning that upward movement of the reel part 220 is restricted so that the reel part 220 in the accommodation space is not moved toward the ratchet-type gear 233.

In addition, the partition plate 230*b* may be provided with a rail guide part 236 at a lower surface portion thereof, and the rail guide part 236 and the rail coupling part 226 are engaged and coupled to each other to guide rotation of the reel part 220.

For this, the rail guide part 236 and the rail coupling part 226 may be provided as a groove and a protrusion that are engaged with each other and have annular cross-sections. That is, as illustrated in the drawings, a pair of annular protrusions protruding in opposite directions may be configured such that an inner circumference of one protrusion is coupled to an outer circumference of the other thereof in a rotatably supported manner.

That is, the rail coupling part 226 may be provided as an annular protrusion protruding upward along an edge of an upper surface portion of the reel part 220, and the rail guide part 236 may be provided as an annular protrusion protruding downward along a lower surface portion of the partition plate 230*b*.

In this case, in a state in which a lower end portion of the reel part 220 is caught by the reel assembling protrusion 235*b*, an overlap interval between the rail guide part 236 and the rail coupling part 226 may be configured to be greater than a smaller one of a distance from the upper surface portion of the reel part 220 to a lower end of the rail guide part 236 and a distance from the lower surface portion of the partition plate 230*b* to an upper end of the rail coupling part 226.

At this time, the reel part 220 may be inserted into the fastening barrier part 230*a* so that an edge of a lower end of the reel part 220 is caught by the reel assembling protrusion 235*b*. In addition, the rail coupling part 226 may be inserted between the rail guide part 236 and the inner circumference of the fastening barrier part 230*a* and rotatably supported thereby.

Accordingly, the reel part 220 may be accurately rotated in a circumferential direction in which the wire L is wound and unwound.

That is, as the rail coupling part 226 is rotated by being guided by the rail guide part 236, the reel part 220 may be stably rotated without a separate rotary shaft 61 (see FIG. 2), and thus the number of constituent components decreases, resulting in enhanced productivity and assemblability of products.

Furthermore, interference of a rotary shaft in a connection portion between the wires L located on an inner side of the reel part 220, i.e., in the knot accommodation groove 228, may be removed, and thus installation and replacement convenience of the wire L may be enhanced.

Meanwhile, referring to FIGS. 3B and 4A, the vertically moving gear part 240 includes a gear body part 240*a*, elastic blade parts 240*c*, and vertical movement fixing extension parts 240*b*. In this case, the vertically moving gear part 240 may have a certain strength or higher and be made of a resin material such as reinforced plastic or the like, which is an elastic material.

In this regard, the gear body part 240*a* has a cylindrical shape having an outer diameter less than an inner diameter of the vertical movement hole 231 so as to vertically move along the vertical movement hole 231, and is provided, at a lower surface portion thereof, with a gear engagement part 244 to be integrally rotated with the reel part 220 when being moved downward.

Specifically, the gear coupling part 224 and the gear engagement part 244 may be configured as a gear groove/gear protrusion inserted into each other and engaged with each other, or a gear protrusion/gear protrusion engaged with each other.

For example, the gear coupling part 224 of the reel part 220 may be configured such that a plurality of gear protrusions, having ends in the direction R which have a vertically stepped shape and ends in the other direction CR which have an inclined shape, is positioned along a circumferential direction.

In addition, the gear engagement part 244 may be configured such that a plurality of gear protrusions, having ends in the direction R which have an inclined shape and ends in the other direction CR which have a vertically stepped shape, is positioned along the circumferential direction.

Accordingly, when the vertically moving gear part 240 is moved downward, inclined portions of the respective gear protrusions may be brought into contact with each other and thus smoothly engaged with each other. In addition, when the vertically moving gear part 240 is rotated in the other direction CR, stepped surfaces of the respective gear protrusions may be brought into contact with each other, and thus a rotational force of the vertically moving gear part 240 may be accurately transmitted to the reel part 220.

In addition, a seating step 247 protrudes from an outer circumference of the gear body part 240*a*, the elastic blade parts 240*c* are provided along an outer circumference of the seating step 247, and the vertical movement fixing extension parts 240*b* are provided along a lower surface portion of the seating step 247.

In this regard, referring to FIGS. 3A and 3B, each elastic blade part 240*c* has a circular arc shape extending in the direction R from an end thereof in the other direction CR, connected to the outer circumference of the seating step 247 to be rounded, and thus an end of the elastic blade part 240*c* in the direction R may be elastically deformed radially.

In this case, the elastic blade part 240*c* is provided, at an end thereof in the direction R, with a ratchet coupling part 243 coupled to the ratchet-type gear 233 to restrict rotation of the elastic blade part 240*c* in the direction R.

That is, the ratchet coupling part 243 includes one or more gear teeth having an end portion in the direction R which has a vertically stepped form and an end portion in the other direction CR which has an inclined form. In addition, the ratchet-type gear 233 includes a plurality of gear teeth having an end portion in the direction R which has an inclined form and an end portion in the other direction CR which has a vertically stepped form.

In this case, the ratchet coupling part 243 is elastically supported in a radially outward direction by an elastic force of the elastic blade parts 240*c* to be engaged with the ratchet-type gear 233.

Specifically, when rotational force in the direction R is applied to the ratchet coupling parts 243, vertical cross-sections of the ratchet coupling parts 243 and the ratchet-type gear 233 may be brought into contact with each other and engaged with each other so that rotation of the vertically moving gear part 240 in the direction R may be restricted.

In addition, when a rotational force in the other direction CR is applied to the ratchet coupling parts 243, inclined surfaces of the ratchet coupling parts 243 and the ratchet-type gear 233 are brought into contact with each other and slid along each other. In addition, in a state in which the elastic blade parts 240*c* are elastically deformed radially inward and outward such that a clicking sense is imparted thereto, the vertically moving gear part 240 may be rotated in the other direction CR.

In this regard, the elastic blade parts 240*c* may be provided at a plurality of positions along the outer circumference of the seating step 247.

In addition, it is more preferable for an auxiliary elastic piece (not shown) and a deformation restriction protrusion (not shown) to be provided between the elastic blade parts 240*c* and the seating step 247. Through this, excessive deformation of the elastic blade parts 240*c* may be prevented, and stable engagement between the ratchet coupling parts 243 and the ratchet-type gear 233 may be maintained.

Specifically, referring to FIGS. 3A to 4B, when the gear body part 240*a* is moved downward by an external force, the gear coupling part 224 and the gear engagement part 244 are brought into close contact with each other to be engaged, and the gear body part 240*a* and the reel part 220 may be integrally rotated.

In addition, when the gear body part 240*a* is rotated in the other direction CR, the reel part 220 is rotated in the other direction CR together with the gear body part 240*a*, and thus the wire L may be wound.

In this case, when an external force is applied to the wire L by movement or the like in a state in which a user wears the object to be tightened, a rotational force in the direction R is applied to the reel part 220.

In this regard, the reel part 220 is in a state of being coupled with the gear body part 240*a* such that the rotational force of the reel part 220 is transmitted to the gear engagement part 244 and the gear body part 240*a* via vertically stepped surfaces of the gear coupling part 224.

At this time, in a state in which rotation of the gear body part 240*a* in the direction R is restricted by the elastic blade parts 240*c*, rotation of the reel part 220 in the direction R is restricted, and the pre-wound wire L may maintain a wound state without being unwound.

In contrast, when the gear body part 240*a* is moved upward by an external force, the gear coupling part 224 and the gear engagement part 244 are separated from each other, and the reel part 220 may be freely rotated independently from the gear body part 240*a*. At this time, when the wire L wound on the reel part 220 is pulled, the wire L may be unwound.

Meanwhile, the vertical movement fixing extension parts 240*b* are selectively elastically supported by upper and lower surfaces of an edge of the vertical movement hole 231 when the gear body part 240*a* is moved upward.

In this regard, the edge of the vertical movement hole 231 may be understood as having the same meaning as an inner radial end portion of the partition plate 230*b*. In addition, the upper and lower surfaces of the edge of the vertical movement hole 231 may be understood as representing upper and lower surface portions of the partition plate 230*b* connected to the inner radial end portion of the partition plate 230*b*.

Specifically, the vertical movement fixing extension parts 240*b* have a circular arc shape having a narrow radial thickness and a wide circumferential width, and thus may be elastically deformed radially inward and outward. At this time, the vertical movement fixing extension parts 240*b* are provided in plural along a circumferential direction, and may be spaced apart from each other at the same angle interval.

In addition, outer surface portions of the vertical movement fixing extension parts 240*b* are configured to come into contact with the edge of the vertical movement hole 231, and inner surface portions thereof protrude downward from a lower surface portion of the seating step 247 to be spaced apart from an outer circumferential surface of the gear body part 240*a*.

In addition, lower end portions of the vertical movement fixing extension parts 240*b* may extend from the edge of the vertical movement hole 231 to protrude downward therefrom in a state in which the vertically moving gear part 240 is lifted. Through this, the gear coupling part 224 and the gear engagement part 244 are separated from each other, and thus the reel part 220 may be freely rotated.

As used herein, the outer surface portion may represent an outer radial side surface, and the inner surface portion may be understood as representing an inner radial side surface.

At this time, each vertical movement fixing extension part 240*b* may be provided, at an outer surface portion facing the edge of the vertical movement hole 231, with a locking protrusion 241 protruding therefrom in the radially outward direction to face the upper and lower surfaces of the edge of the vertical movement hole 231 when the gear body part 240*a* is moved upward.

That is, the locking protrusions 241 are elastically supported by the upper and lower surfaces of the edge of the vertical movement hole 231 when the gear body part 240*a* is moved upward, and the lifted state of the vertically moving gear part 240 may be maintained by the locking protrusions 241.

At this time, a distance from an outer surface of the vertical movement fixing extension part 240*b* to a maximum outer diameter portion of the locking protrusion 241 may be less than or equal to a distance from an inner surface of the vertical movement fixing extension part 240*b* to the outer circumference of the gear body part 240*a*.

Accordingly, the vertical movement fixing extension parts 240*b* are elastically deformed radially outward, and the locking protrusions 241 may be vertically moved by passing through the edge of the vertical movement hole 231.

In addition, when the locking protrusions 241 pass through the edge of the vertical movement hole 231, the vertical movement fixing extension parts 240*b* are elastically restored in a radially inward direction, and, accordingly, the locking protrusions 241 may be elastically supported by the upper or lower surface portion of the edge of the vertical movement hole 231.

At this time, the locking protrusions 241 may protrude such that upper end portions thereof are elastically caught by the lower surface portion of the edge of the vertical movement hole 231 at a position at which the vertically moving gear part 240 is lowered, i.e., the gear coupling part 224 and the gear engagement part 244 are mutually engaged.

Specifically, the locking protrusions 241 are elastically supported in the radially inward direction by an elastic force of the vertical movement fixing extension parts 240*b* at the lowered position of the vertically moving gear part 240, and the upper end portions of the locking protrusions 241 are caught by the lower surface portion of the edge of the vertical movement hole 231.

At this time, when an upward external force that is less than or equal to the elastic force of the vertical movement fixing extension parts 240*b* is applied to the vertically moving gear part 240, an elastically caught state of the locking protrusions 241 is maintained, and thus the vertically moving gear part 240 is not moved upward. That is, the vertically moving gear part 240 may be moved upward only when upward external force exceeding the elastic force of the vertical movement fixing extension parts 240*b* is applied to the vertically moving gear part 240.

Accordingly, the lowered state of the vertically moving gear part 240 is stably maintained, and the gear engagement part 244 of the gear body part 240*a* and the gear coupling part 224 of the reel part 220 may be stably engaged.

Through this, an integrally rotated state of the reel part 220 and the vertically moving gear part 240 may be stably maintained such that the wire L is wound through rotation in the other direction CR and the wound wire L is unwound due to restricted rotation in the direction R.

That is, a malfunction such as an upward movement of the vertically moving gear part 240 due to motion shock, or the like, instead of a direct manipulation of a user may be prevented. Accordingly, a sudden unwinding of the wire L according to the malfunction of the vertically moving gear part 240 and accidents related thereto may be prevented, and thus safety of products may be enhanced.

In addition, a sum of vertical thicknesses of the locking protrusion 241 and the edge of the vertical movement hole 231, i.e., an inner radial side end of the partition plate 230*b*, may exceed a vertical movement interval of the vertically moving gear part 240 or the gear body part 240*a*.

As used herein, the vertical movement interval refers to a distance from a position of the vertically moving gear part 240 at which the gear coupling part 224 and the gear engagement part 244 are brought into close contact with each other so that the reel part 220 and the vertically moving gear part 240 are integrally rotated to a position of the vertically moving gear part 240 at which the gear coupling part 224 and the gear engagement part 244 are separated from each other so that the reel part 220 is freely rotated independently from the vertically moving gear part 240.

At this time, when the vertically moving gear part 240 is moved upward so that the gear coupling part 224 and the gear engagement part 244 are separated from each other, the locking protrusions 241 are moved upward by passing through the edge of the vertical movement hole 231. In addition, the lower end portions of the locking protrusions 241 may be elastically supported by the upper surface portion of the edge of the vertical movement hole 231.

Specifically, the locking protrusions 241 are elastically supported in the radially inward direction by the elastic force of the vertical movement fixing extension parts 240*b* at the lifted position of the vertically moving gear part 240, and the lower end portions of the locking protrusions 241 are elastically supported by the upper surface portion of the edge of the vertical movement 231.

Through this, the lifted state of the vertically moving gear part 240, i.e., the freely rotated state of the reel part 220, may be maintained. Accordingly, when the vertically moving gear part 240 is only pulled upward, the wire L may be unwound by being pulled without a separate manipulation, and, accordingly, convenience of use of products may be enhanced.

In addition, in a case in which unwinding of the wire L is completed, when the vertically moving gear part 240 is pressed downward, the state of the gear coupling part 224 and the gear engagement part 244 may be easily converted into a coupled state.

As such, the vertical movement fixing extension parts 240*b* extending downward from an upper end portion of the vertically moving gear part 240, i.e., the seating step 247, are elastically caught by the edge of the vertical movement hole 231 of the housing part 230, and thus the vertical movement state of the vertically moving gear part 240 may be maintained.

Accordingly, additional components such as the rotary shaft 61 (see FIG. 2), an elastic member 59 (see FIG. 2), and the like conventionally used to maintain the vertical movement state of the vertically moving gear part 240 are not needed, and thus the number of components decreases to 5 or less, and, accordingly, productivity and assemblability of products may be enhanced.

In addition, the vertical movement fixing extension parts 240*b* extend to face the inner side end of the partition plate 230*b* protruding to restrict the upper end portion of the reel part 220, i.e., the edge of the vertical movement hole 231, and thus the locking protrusions 241 protruding from the vertical movement fixing extension parts 240*b* may be elastically caught by the edge of the vertical movement hole 231.

Accordingly, a separate protruding or recessed structure for elastically locking the locking protrusions 241, such as protrusions, steps, grooves, or the like, is not needed, and thus a structure of the housing part 230 may be simplified. Through this, difficulties in molding and fabrication of the housing part 230 are reduced, and thus productivity of products may be enhanced.

In this regard, the locking protrusion 241 may be provided, at upper and lower end portions thereof, with gradient surfaces 241*b* and 241*c* being in contact with the edge of the vertical movement hole 231 to induce elastic deformation of the vertical movement fixing extension parts 240*b*.

Specifically, the edge of the vertical movement hole 231 may be understood as having a concept including an inner radial side end portion of the partition plate 230*b*, i.e., an inner radial side end and edge portions of upper and lower ends connected thereto of the partition plate 230*b*.

At this time, it is preferable for the gradient surface 241*b* to be formed such that the upper end side of the locking protrusion 241 is inclined downward in the radially outward direction, and the gradient surface 241*c* to be formed such that the lower end side of the locking protrusion 241 is inclined upward in the radially outward direction. In addition, the gradient surfaces 241*b* and 241*c* may be replaced by inclined surfaces formed in the same inclined direction thereof.

Accordingly, each of the gradient surfaces 241*b* and 241*c* may be smoothly slid due to being in contact with the edge of the vertical movement hole 231, thereby inducing radially outward elastic deformation of the vertical movement fixing extension parts 240*b*.

Through this, vertical movement of the vertically moving gear part 240 for converting a restricted state of free rotation and rotation in the direction R of the reel part 220 may be performed more smoothly, and thus convenience of use of products may be enhanced.

Meanwhile, the cover part 250 may be made of a resin material such as reinforced plastic or the like, and is coupled to an upper portion of the vertically moving gear part 240, and the vertically moving gear part 240 may be vertically moved and rotated by an external force transmitted by the cover part 250.

At this time, the cover part 250 is provided in the form of an upside down container, and a side wall portion 250*a* thereof is configured to have an inner diameter exceeding that of the upper end portion of the housing part 230. Accordingly, the upper end portion of the housing part 230 and the elastic blade parts 240*c* of the vertically moving gear part 240 may be inserted into the side wall portion 250*a*.

Specifically, cover fastening parts 242 may be formed at an upper surface portion of the gear body part 240*a*, and a gear assembly elastic piece 252 may protrude from a lower surface portion of a top plate 250*b* of the cover part 250.

In this regard, the gear assembly elastic piece 252 may be provided, at an outer surface portion thereof, with a gear assembly protrusion 252*a* protruding therefrom in the radially outward direction, and the cover fastening part 242 may be provided as a groove or hole having a circumferential width corresponding to that of the gear assembly elastic piece 252.

At this time, the cover fastening part 242 is provided, at an upper end portion thereof, with a step which catches the gear assembly protrusion 252*a*. In this case, a distance from an upper end portion of the gear assembly protrusion 252*a* to the lower surface portion of the top plate 250*b* of the cover part 250 is configured to correspond to an interval between a lower end of the step and an upper surface of the gear body part 240*a*.

Accordingly, when the gear assembly protrusion 252*a* is caught by the step, the top plate 250*b* of the cover part 250 and the upper surface portion of the gear body part 240*a* may be coupled to each other in a close contact state. In addition, opposite circumferential ends of the gear assembly elastic piece 252 are restricted by opposite ends of the cover fastening part 242, and thus the vertically moving gear part 240 and the cover part 250 may be integrally rotated and vertically moved.

Also, the cover fastening part 242 may be formed at a lower surface portion of the top plate 250*b* of the cover part 250, and a gear assembly elastic piece may protrude from an upper surface portion of the gear body part 240*a*.

In addition, the cover part 250 may be provided, at an inner circumference of the side wall portion 250*a* thereof, with a hook protrusion 251 protruding therefrom to be hook-coupled to a fastening step 232 protruding from an outer surface of the fastening barrier part 230*a*.

That is, the side wall portion 250*a* of the cover part 250 is configured to have an inner diameter corresponding to an outer diameter of the fastening step 232, and thus the hook protrusion 251 protruding radially inward from the inner circumference of the side wall portion 250*a* may be caught by a lower end of the fastening step 232.

At this time, a lower end portion of the hook protrusion 251 is formed to be inclined upward in the radially inward direction, while an upper end portion thereof is formed to be flat, and an upper end portion of the fastening step 232 is formed to be inclined downward in the radially outward direction while a lower end portion thereof is formed to be flat.

Accordingly, the inclined lower end portion of the hook protrusion 251 is slid along the inclined upper end portion of the fastening step 232, and thus the hook protrusion 251 may be smoothly moved downward along the fastening step 232. In addition, the flat upper end portion of the hook protrusion 251 is caught by the flat lower end portion of the fastening step 232, and thus the cover part 250 and the housing part 230 may be stably hook-coupled to each other.

As such, constituent components, such as the housing part 230, the vertically moving gear part 240, the cover part 250, and the like, may be simply coupled by vertically pressing two neighboring components, and thus assemblability and productivity of products may be enhanced.

Meanwhile, referring to FIGS. 4A and 4B, the hook protrusion 251 may be configured to have a gap interval b corresponding to the vertical movement interval of the gear body part 240*a* in a state of being hook-coupled to the fastening step 232.

As used herein, the gap interval b refers to a maximum vertical movement range of the cover part 250 in the hook-coupled state in which the hook protrusion 251 is located at a lower portion of the fastening step 232.

For this, the length of the side wall portion 250*a* of the cover part 250 and the position of the hook protrusion 251 may be configured such that a distance from an upper end of the hook protrusion 251 to the lower end of the fastening step 232 corresponds to the vertical movement interval at the lowered position of the vertically moving gear part 240 at which the gear coupling part 224 and the gear engagement part 244 are brought into close contact with each other.

That is, the vertically moving gear part 240 and the reel part 220 may be brought into close contact with each other in a state in which the upper end of the hook protrusion 251 is separated from the lower end of the fastening step 232. In addition, the vertically moving gear part 240 and the reel part 220 may be separated from each other at a position at which the upper end of the hook protrusion 251 is brought into close contact with the lower end of the fastening step 232.

Accordingly, the vertically moving gear part 240 may be smoothly vertically moved from the lowered position thereof coupled to the reel part 220 to the lifted position thereof separated from the reel part 220 in a state in which coupling between the housing part 230 and the cover part 250 is maintained.

In addition, the gap interval b may be configured to be equal to or greater than an engagement distance between the gear coupling part 224 and the gear engagement part 244. Through this, when the cover part 250 is vertically moved according to the gap interval b, a state the vertically moving gear part 240 and the reel part 220 may be accurately converted between the coupled state and the separated state.

At this time, the ratchet-type gear 233 and the ratchet coupling part 243 may be separated from each other when the cover part 250 is maximally moved upward, and may be recoupled to each other when the cover part 250 is moved downward.

In addition, an engagement height a between the ratchet-type gear 233 and the ratchet coupling part 243 may be configured to be equal to or greater than the gap interval b. At this time, while the coupled state of the ratchet-type gear 233 and the ratchet coupling part 243 is maintained, the cover part 250 may be vertically moved and states of the reel part 220 and the vertically moving gear part 240 may be converted between the coupled state and the separated state.

As such, the housing part 230, the vertically moving gear part 240, the cover part 250, and the base body part 210 that constitute the wire tightening apparatus 200 may be assembled via simple hook coupling by vertically pressing two neighboring components. Accordingly, each constituent component may be easily assembled without a separate fixing member.

In addition to enhancing product assemblability, breakdown of resin material components due to metal material components used as fixing members during manipulation by an external force may be fundamentally prevented, and thus product durability may be enhanced.

In addition, the vertically moving gear part 240 configured to be vertically moved to convert between free rotation and one-way rotation states of the reel part 220 may be elastically supported by the edge of the vertical movement hole 231 via the vertical movement fixing extension parts 240*b*, and thus a vertically moved state thereof may be maintained.

Due to this, a malfunction due to a vibration and impact when the vertically moving gear part 240 is lowered may be prevented, and easy release of a wire is enabled when the vertically moving gear part 240 is lifted, and thus safety and convenience of use of products may be enhanced.

In addition, the vertical movement fixing extension parts 240*b* are integrally provided at the vertically moving gear part 240, and thus the number of constituent components such as the elastic member 59 (see FIG. 2) configured to maintain the lowered state of the vertically moving gear part 240 decreases, and, accordingly, productivity and assemblability of products may be enhanced.

The wire tightening apparatus 200 according to the present invention is not limited to only being used in shoes. That is, the wire tightening apparatus 200 according to the present invention may be applied to a variety of apparatuses worn by tightening a wire or lace of an accessory such as a hat, a helmet, a belt, gloves, and a bag, sport equipment such as a snow board and water skis, other clothes, and the like. In addition, the application thereof to other apparatuses to which the spirit of the present invention is applied is also construed as being within the scope of the present invention.

As is apparent from the foregoing description, the present invention is not limited to each of the above-described embodiments, and modification of the present invention may be made by one of ordinary skill in the art to which the present invention pertains without departing from the scope of claims of the present invention, and such modification is construed as falling within the scope of the present invention.

INDUSTRIAL APPLICABILITY

The present invention provides a wire tightening apparatus industrially applicable for manufacturing a variety of apparatuses using tightening of a wire or a lace.

The invention claimed is:

1. A wire tightening apparatus comprising:

a base body part provided with an accommodation barrier part at an upper surface portion thereof;

a reel part rotatably installed inside the accommodation barrier part to selectively wind a wire thereon when rotated;

a housing part comprising: a fastening barrier part having a lower end portion coupled to the accommodation barrier part and provided, at an upper end portion of an inner circumference thereof, with a ratchet-type gear protruding therefrom; and a partition plate protruding radially inward along a lower portion of the ratchet-type gear so that an upper end of the reel part is restricted, and having a vertical movement hole in a central portion thereof;

a vertically moving gear part comprising: a gear body part configured to be vertically moved along the vertical movement hole, coupled to the reel part when moved downward to be integrally rotated therewith, and having a seating step protruding from an outer circumference thereof; an elastic blade part provided at an outer circumference of the seating step and coupled to the ratchet-type gear so that one-way rotation thereof is restricted; and a vertical movement fixing extension part protruding from a lower surface portion of the seating step and selectively elastically supported by upper and lower surfaces of an edge of the vertical movement hole; and a cover part coupled to an upper portion of the vertically moving gear part to be integrally vertically moved and rotated therewith.

2. The wire tightening apparatus of claim 1, wherein the vertical movement fixing extension part extends to face the edge of the vertical movement hole, and is provided, at an outer surface portion thereof, with a locking protrusion protruding radially outward to face the upper and lower surfaces of the edge of the vertical movement hole, wherein the locking protrusion is provided, at upper and lower end portions thereof, with gradient surfaces to be brought into contact with the edge of the vertical movement hole to induce elastic deformation of the vertical movement fixing extension part.

3. The wire tightening apparatus of claim 1, wherein the cover part is provided, at an inner circumference of a side wall portion thereof, with a hook protrusion protruding therefrom to be hook-coupled to a fastening step protruding from an outer surface of the fastening barrier part, and have a gap interval corresponding to a vertical movement interval of the gear body part from the fastening step when hook coupling is performed.

4. The wire tightening apparatus of claim 1, wherein an upper surface portion of the reel part and a lower surface portion of the partition plate are provided with a rail coupling part and a rail guide part, the rail coupling part and the rail guide part being engaged with each other and coupled to guide rotation of the reel part, and the reel part is provided, at a side wall portion thereof, with a pair of wire fastening holes to be alternately vertically arranged, wherein the wire fastening holes allow opposite ends of the wire to pass therethrough and be restricted thereby so that the restricted opposite ends are separated from each other and wound when the reel part is rotated.

5. The wire tightening apparatus of claim 1, wherein the fastening barrier part is provided, at an inner circumference thereof, with a reel assembling protrusion to protrude therefrom in a radially inward direction so that a lower end portion of the reel part is elastically caught thereby.

* * * * *